US006889921B2

(12) United States Patent
Schaupp

(10) Patent No.: US 6,889,921 B2
(45) Date of Patent: May 10, 2005

(54) BELL CUP SKIRT

(75) Inventor: John Schaupp, Toledo, OH (US)

(73) Assignee: Illinois Tool Works Inc., Glenview, IL (US)

( * ) Notice: Subject to any disclaimer, the term of this patent is extended or adjusted under 35 U.S.C. 154(b) by 64 days.

(21) Appl. No.: 10/262,239

(22) Filed: Sep. 30, 2002

(65) Prior Publication Data

US 2004/0069877 A1 Apr. 15, 2004

(51) Int. Cl.[7] ..... B05B 5/00; B05B 3/10; F23D 11/32; F23D 11/04; B44D 5/10

(52) U.S. Cl. ..... 239/700; 239/701; 239/703; 239/704; 239/706; 239/223

(58) Field of Search ..... 239/296, 591, 239/700, 701, 703, 704, 706, 223, 690–699, 702, 705, 707, 708, 224, 214.25, 240; 222/402.1, 481.5, 482

(56) References Cited

U.S. PATENT DOCUMENTS

| | | | | |
|---|---|---|---|---|
| 2,759,763 | A | | 8/1956 | Juvinall |
| 2,955,565 | A | | 10/1960 | Schotland |
| 3,102,062 | A | | 8/1963 | Graham et al. |
| 3,233,655 | A | | 2/1966 | Graham |
| 3,575,344 | A | | 4/1971 | Angelico |
| 3,578,997 | A | | 5/1971 | Felici |
| 3,589,607 | A | | 6/1971 | Wolf |
| 3,610,528 | A | | 10/1971 | Felici |
| 3,684,174 | A | | 8/1972 | Bein |
| 3,698,636 | A | | 10/1972 | Szasz |
| 3,744,678 | A | * | 7/1973 | Beres et al. ..... 222/205 |
| 3,843,054 | A | | 10/1974 | Kendall et al. |
| 3,865,283 | A | * | 2/1975 | Hayes ..... 222/402.11 |
| 3,913,523 | A | | 10/1975 | Probst et al. |
| 3,964,683 | A | | 6/1976 | Gimple |
| 4,039,145 | A | | 8/1977 | Felici et al. |
| 4,066,041 | A | | 1/1978 | Buschor et al. |
| 4,114,564 | A | | 9/1978 | Probst |
| 4,135,667 | A | | 1/1979 | Benedek et al. |
| 4,169,560 | A | | 10/1979 | Vohringer |
| 4,171,100 | A | | 10/1979 | Benedek et al. |
| 4,214,708 | A | | 7/1980 | Lacchia |
| 4,215,818 | A | | 8/1980 | Hopkinson |
| 4,216,915 | A | | 8/1980 | Hengartner et al. |

(Continued)

FOREIGN PATENT DOCUMENTS

| | | |
|---|---|---|
| FR | 1274814 | 9/1961 |
| GB | 1209653 | 10/1970 |
| JP | 58-124560 | 7/1983 |
| JP | 60-94166 | 5/1985 |
| JP | 60-151554 | 10/1985 |
| JP | 62-140660 | 6/1987 |
| JP | 63-116776 | 5/1988 |
| JP | 1-315361 | 12/1989 |
| JP | 3-169361 | 7/1991 |
| JP | 3-221166 | 9/1991 |

*Primary Examiner*—David A. Scherbel
*Assistant Examiner*—Darren Gorman
(74) *Attorney, Agent, or Firm*—Barnes & Thornburg LLP

(57) ABSTRACT

A dispensing device for dispensing a material. The dispensing device includes a somewhat cup-shaped interior opening in a first direction in which the material is to be dispensed from the dispensing device. The interior terminates at a discharge edge. The dispensing device further includes a skirt extending from the discharge edge in a second direction generally opposite the first direction. The skirt includes multiple passageways substantially equally spaced around a perimeter of the skirt.

32 Claims, 3 Drawing Sheets

U.S. PATENT DOCUMENTS 4,323,197 A 4/1982 Morishita et al.
4,350,304 A 9/1982 Sugiyama et al.
4,360,155 A 11/1982 Hubbell et al.
4,402,991 A 9/1983 Meisner
4,420,099 A * 12/1983 Pizzurro et al. ..... 222/205
4,422,577 A 12/1983 Arnold et al.
RE31,590 E 5/1984 Mitsui
4,450,785 A 5/1984 Meisner
4,505,430 A 3/1985 Rodgers et al.
RE31,867 E 4/1985 Kennon
4,518,119 A 5/1985 Vetter
4,520,754 A 6/1985 Gange et al.
4,580,727 A 4/1986 Moos
4,598,870 A 7/1986 Schloz
4,685,620 A 8/1987 Law et al.
4,726,521 A 2/1988 Simm et al.
4,776,520 A * 10/1988 Merritt ..... 239/700
4,779,805 A 10/1988 Jackson et al.
4,785,995 A 11/1988 Yamane et al.
4,788,933 A 12/1988 Buschor
4,798,340 A 1/1989 Vohringer et al.
4,802,625 A 2/1989 Buschor
4,825,807 A 5/1989 Nakamura et al.
4,838,487 A * 6/1989 Schneider ..... 239/223
4,879,137 A 11/1989 Behr et al.
4,890,190 A 12/1989 Hemming
4,896,384 A 1/1990 Dijkhuizen
4,899,936 A * 2/1990 Weinstein ..... 239/224
4,921,172 A 5/1990 Belmain et al.
5,353,995 A 10/1994 Chabert
5,584,435 A * 12/1996 Lind ..... 239/73
5,768,800 A 6/1998 Merritt et al.
5,853,126 A 12/1998 Alexander
5,893,517 A * 4/1999 Delamare ..... 239/223
5,978,244 A 11/1999 Hughey
6,003,785 A * 12/1999 Duey ..... 239/223
6,144,570 A 11/2000 Hughey
6,328,224 B1 12/2001 Alexander
6,347,754 B1 * 2/2002 Prus ..... 239/690
6,676,049 B2 * 1/2004 van der Steur ..... 239/690

* cited by examiner

BELL CUP SKIRT

FIELD OF THE INVENTION

This invention relates to dispensers for dispensing coating materials such as liquid coating materials (hereinafter sometimes "paint") or pulverulent coating materials (hereinafter sometimes "coating powder" or "powder") suspended in gas streams, for example, a stream of air, from, for example, a fluidized powder bed. It is disclosed in the context of a rotary dispenser (hereinafter sometimes a "bell"). However, it is believed to have utility in other applications as well.

BACKGROUND OF THE INVENTION

Systems for dispensing coating materials are known. There are, for example, the systems illustrated and described in U.S. Pat. Nos. 3,575,344; 3,698,636; 3,843,054; 3,913,523; 3,964,683; 4,039,145; 4,114,564; 4,135,667; 4,169,560; 4,216,915; 4,360,155; 4,450,785; Re. 31,867; 4,520,754; 4,580,727; 4,598,870; 4,685,620; 4,788,933; 4,798,340; 4,802,625; 4,825,807; 4,921,172; 5,353,995; 5,853,126; and, 6,328,224. There are also the devices illustrated and described in U.S. Pat. Nos. 2,759,763; 2,955,565; 3,102,062; 3,233,655; 3,578,997; 3,589,607; 3,610,528; 3,684,174; 4,066,041; 4,171,100; 4,214,708; 4,215,818; 4,323,197; 4,350,304; 4,402,991; 4,422,577; Re. 31,590; 4,505,430; 4,518,119; 4,726,521; 4,779,805; 4,785,995; 4,879,137; 4,890,190; and, 4,896,384; British Patent Specification 1,209,653; Japanese published patent applications: 62-140,660; 1-315,361; 3-169,361; 3-221,166; 60-151,554; 60-94,166; 63-116,776; 58-124,560; and 331,823 of 1972; and, French patent 1,274,814.

DISCLOSURE OF THE INVENTION

According to an aspect of the invention, a dispensing device for dispensing a material has a somewhat cup-shaped interior opening in a first direction in which the material is to be dispensed from the dispensing device. The interior terminates at a discharge edge. A skirt extends from the discharge edge in a second direction generally opposite the first direction.

Illustratively according to this aspect of the invention, the apparatus includes a housing. The housing includes a feature cooperating with the skirt. The dispensing device is movable relative to the housing. The skirt and feature at least partly enclose a region defined between the housing and the dispensing device.

Additionally illustratively according to this aspect of the invention, the apparatus includes a source of a compressed gas or mixture of gases coupled to the region. Compressed gas from the source is exhausted from the region through the passageway.

Further illustratively according to this aspect of the invention, the apparatus includes means for mounting the dispensing device on a rotator for rotating the dispensing device about an axis of rotation to aid in dispensing the material.

Illustratively according to this aspect of the invention, the skirt includes a first side and a second side. At least one passageway extends through the skirt from the first side to the second side.

Illustratively according to this aspect of the invention, the dispensing device includes multiple passageways substantially equally spaced around a perimeter of the skirt.

According to another aspect of the invention, a dispensing device is provided for dispensing a material. A housing surrounds the dispensing device. The housing and dispensing device include cooperating first and second features. The dispensing device is movable relative to the housing. The first and second features at least partly enclose a region defined between the housing and the dispensing device. The cooperating first and second features include a skirt and a groove for receiving the skirt.

Illustratively according to this aspect of the invention, the skirt extends around a perimeter of the dispensing device. The groove extends along a surface of the housing.

Further illustratively according to this aspect of the invention, the apparatus includes a rotator. The dispensing device is mounted on the rotator for rotation thereby.

Additionally illustratively according to this aspect of the invention, the rotator is housed in the housing.

Illustratively according to this aspect of the invention, one of the first and second features includes at least one passageway. A first source of a compressed gas or mixture of gases is coupled to the region. Compressed gas from the first source is exhausted from the region through the passageway.

Illustratively according to this aspect of the invention, there are a plurality of said passageways substantially equally spaced around a perimeter of the skirt.

According to yet another aspect of the invention, a first source provides a compressed gas or mixture of gases. A second source provides material to be dispensed. A dispensing device is mounted on a rotator for rotation thereby. The second source is coupled to the dispensing device. A housing surrounds the dispensing device. The housing and dispensing device include cooperating first and second features. The first and second features at least partly enclose a region defined between the housing and the dispensing device. One of the first and second features includes at least one passageway. The first source is coupled to the region. Compressed gas from the first source is exhausted from the region through the passageway.

Illustratively according to this aspect of the invention, the cooperating first and second features include a skirt and a groove for receiving the skirt.

Additionally illustratively according to this aspect of the invention, the skirt extends around a perimeter of the dispensing device and the groove extends along a surface of the housing.

Illustratively according to this aspect of the invention, the at least one passageway is provided in the skirt.

Additionally illustratively according to this aspect of the invention, there are multiple passageways substantially equally spaced around a perimeter of the skirt.

Illustratively according to this aspect of the invention, the material comprises pulverulent material entrained in a stream of a compressed gas or mixture of gases.

Illustratively according to this aspect of the invention, the second source includes a device for fluidizing pulverulent material.

Illustratively according to this aspect of the invention, the pulverulent material comprises a coating powder. The device for fluidizing pulverulent material comprises a fluidized bed.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 1:
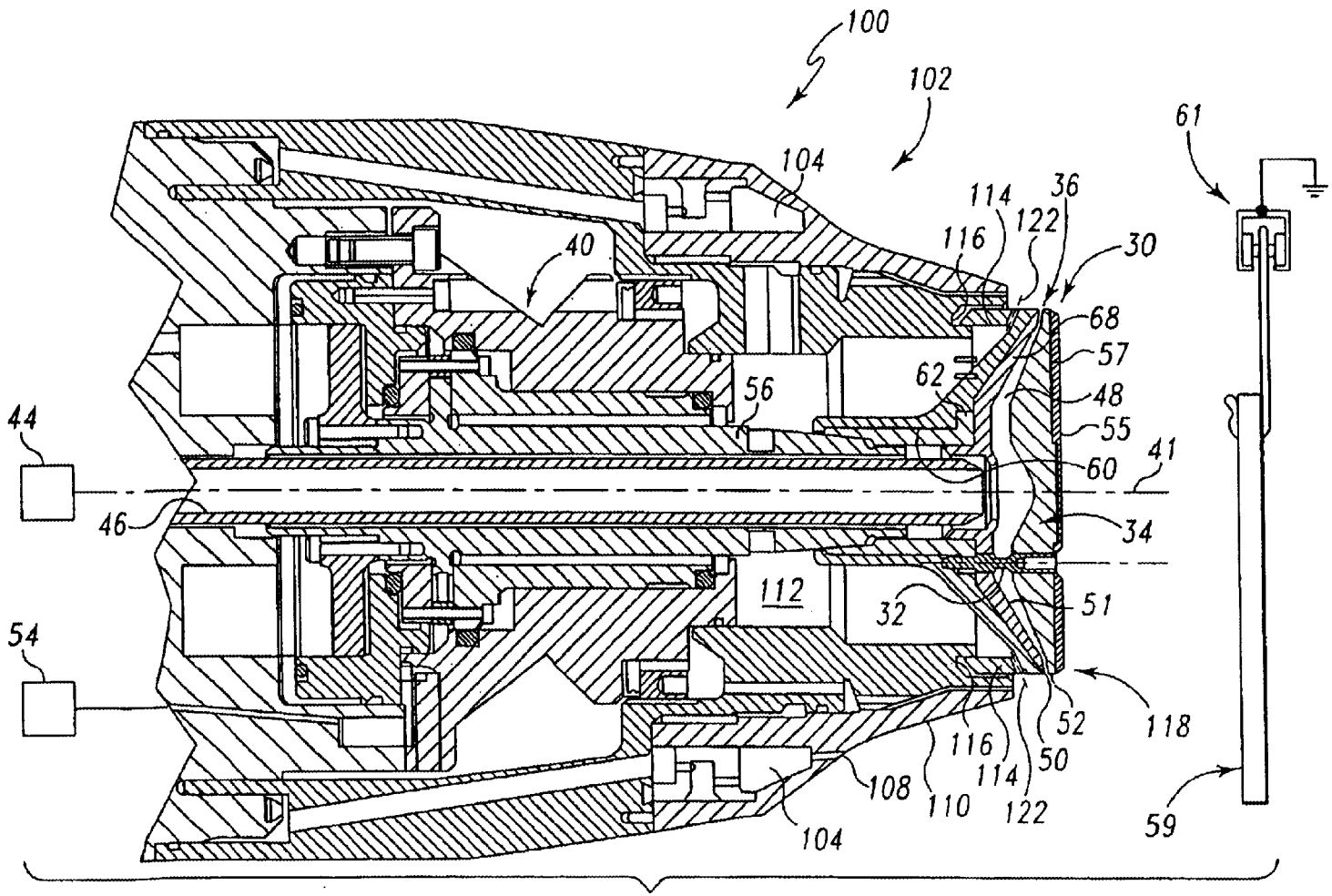
FIG. 1 illustrates a system constructed according to an aspect of the invention, with certain components of the system illustrated in sectional side elevational view, and other components of the system illustrated diagrammatically.
Figure 2:
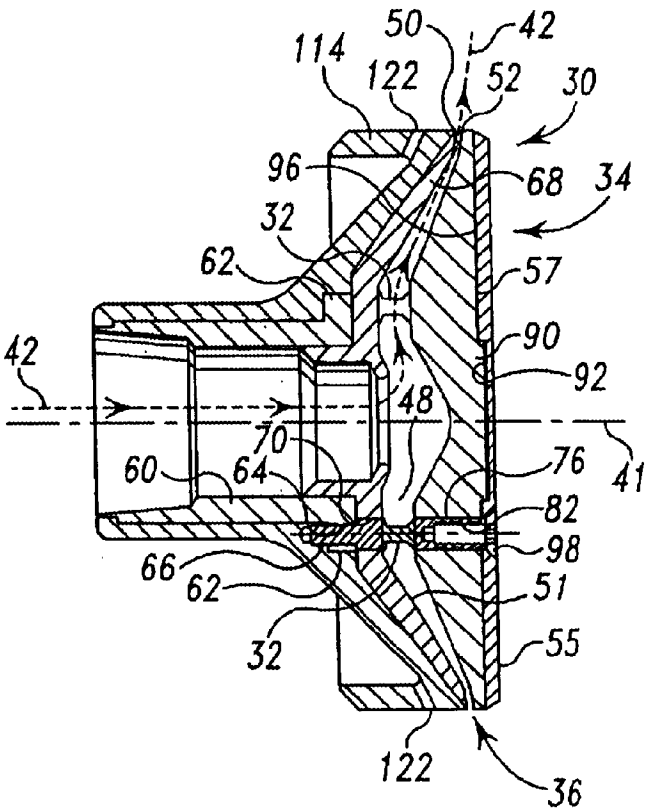
FIG. 2 illustrates a somewhat enlarged sectional side elevational view of a detail of the system illustrated in FIG. 1; and, FIG. 3 illustrates another system constructed according to an aspect of the invention, with certain components of the system illustrated in sectional side elevational view, and other components of the system illustrated diagrammatically.

Referring to FIG. 1, a powder bell cup 30 defining an interior surface 51 is mounted on a turbine 40 of any of a number of known types, for example, one of the general type illustrated and described in U.S. Pat. Nos. 5,853,126 and 6,328,224. Turbine 40 rotates the cup 30 about the cup 30's axis 41. Powder entrained in a stream 42 of a transporting gas, such as a stream of air, flows from a source 44, such as, for example, a fluidized bed containing the powder to be dispensed, through a conduit 46 to the back 48 of the bell cup 30. The source 44 may be one of any of a number of known types, for example, a fluidized bed of the general type illustrated and described in U.S. Pat. No. 5,768,800. The powder streams 42 from the conduit 46, through an opening 36 defined between the axially forward and radially outward extent, or edge, 50 of the interior surface 51 the bell cup 30 and the radially outward extent, or edge, 52 of a diffuser 34, and out through the annular opening 36.

A high-magnitude potential source 54 is coupled to a final charging electrode 55 provided on the forward face 57 of the diffuser 34, that is, the face 57 facing generally toward an article 59 to be coated by the powder dispensed from the bell cup 30. The exposure of the streaming powder 42 to the charged electrode 55 results in charge being imparted upon the powder as it is being dispensed, with the result that the powder is attracted toward the article 59 which is maintained at low-magnitude, for example, ground, electrical potential. The article 59 is maintained at low-magnitude electrical potential by, for example, transporting the article 59 past the bell cup 30 on a grounded conveyor 61.

The electrical charge is provided by, for example, a high-magnitude electrostatic potential supply 54 of any of a number of known types, for example, one of the general type illustrated and described in U.S. Pat. No. 5,978,244 or U.S. Pat. No. 6,144,570. The power supply 54 is coupled to an electrically conductive component of the turbine 40, for example, the turbine 40's output shaft 56, which, in turn, is coupled to electrically conductive diffuser 34-mounting posts 32 through an electrically conductive component of the bell cup 30, such as its shaft 56-receiving sleeve 60. Sleeve 60 is provided with a flange 62 or the like including threaded openings 64 for receiving complementary threads 66 on the posts 32. During assembly, a cup 30 liner 68 of the general type described in U.S. Pat. Nos. 5,853,126 and 6,328,224 is inserted into the bell cup 30. Then, a plurality of posts 32, illustratively three, are inserted through openings 70 provided therefor in liner 68 and threaded 66 into openings 64 in flange 62.

The forward ends 76 of the posts 32 are provided with axial, threaded openings 82. The plate-like charging electrode 55 is located on the forward face 57 of the diffuser 34, illustratively with the aid of features 90, 92, such as a boss 90 and relief 92 formed on the facing surfaces 57, 96 of the diffuser 34 and charging electrode 55. Then, electrically conductive screws 98 are threaded into the threaded openings 82 in the forward ends of posts 32 to secure the diffuser 34 and electrode 55 to the bell cup 30 and electrically couple electrode 55 through posts 32, sleeve 60 and shaft 56 to supply 54.

The posts 32 establish the width of the annular opening 36, support the diffuser 34 and the charging electrode 55 on the front of the diffuser 34, and provide a conductive path 56, 60, 62, 32, 98 from the high magnitude potential source 54 to the electrode 55, in order to charge the powder streaming 42 through the annular opening 36.

The turbine 40 is housed within a shroud 100. Shroud 100 is provided at its forward end 102 with an annular gallery 104. Gallery 104 is provided with a compressed gas or mixture of gases, for example, compressed air, from a source such as so-called "factory compressed air," turbine 40 exhaust air, or some combination of these and/or other source. The forward end 102 of the shroud 100 adjacent gallery 104 is provided with a number of perimetrally spaced passageways 108 between gallery 104 and the exterior 110 of forward end 102. The compressed gas streaming from gallery 104 through these passageways 108 helps to shape the cloud of powder streaming from annular opening 36 and propel the powder in the cloud toward the article 59.

A region 112 defined within the shroud 100 and behind the bell cup 30 is substantially closed by cooperating features 114, 116 such as a cooperating perimetral skirt 114 and skirt 114-receiving groove 116. Shaft 56 and conduit 46 project into region 112, where bell cup 30 is mounted onto shaft 56. In the illustrated embodiments, the skirt 114 is a rearwardly extending skirt 114 on the bell cup 30 and the groove 116 extends around the opening 118 in the end 102 of the shroud 100. Although the cooperating skirt 114 and groove 116 do not completely seal the region 112, there is sufficient volume of compressed gas available that compressed gas streams from passageways 122 provided in skirt 114. The compressed gas streams exiting from passageways help shape and contain the powder cloud exiting from opening 36. The passageways 122 are angled to radii from shaft 56 and angled forwardly from region 112 toward the article 59.

The close tolerance of, for example, <0.050 inch (about 1 mm) between features 114, 116 promote reduction of contaminants which might otherwise be deposited on the back side of bell cup 30 or in region 112 within shroud 100, thereby reducing the possibility that such contaminants might be dislodged from the back side of bell cup 30, be deposited upon, and thereby contaminate the coating on article 59. The flow of gas through passageways 122 is believed to enhance the reduction of contaminants on and between features 114, 116 and in region 112.

Figure 3:
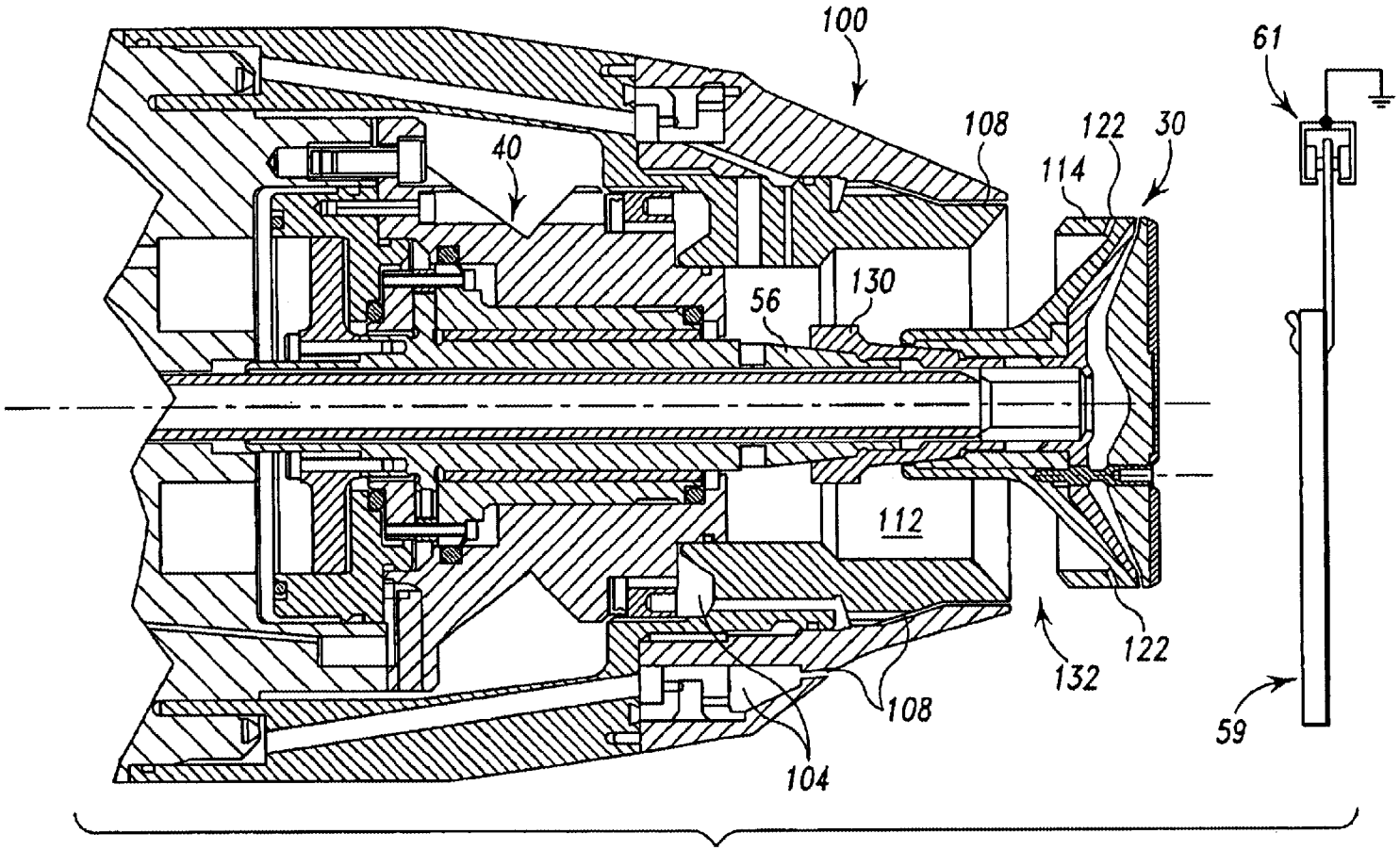

In another embodiment illustrated in FIG. 3, the skirt 114 does not engage a groove provided in the shroud 100. Rather, the bell cup 30 is spaced sufficiently forward on shaft 56 by, for example, a spacer 130 provided on shaft 56 that a gap 132 exists between shroud 100 and skirt 114. The passageways 122 are angled to radii from shaft 56 and angled forwardly from region 112 toward the article 59. Rotation of bell cup 30 by turbine 40 thus results in air being pumped from the back of bell cup 30 through passageways 122 to the radially outer side of skirt 114. The resulting air flow aids to control the shroud air enveloping the dispensed coating material, and thus the pattern of the dispensed coating material.

In appropriate circumstances, the air flow which results from the provision of passageways 122, either in embodiments like FIG. 1 or embodiments like FIG. 3, can provide sufficient shaping air flow that the shroud air flowing from galleries 104 and passageways 108 can be reduced or eliminated.

What is claimed is:

1. A dispensing device for dispensing a material, the dispensing device defining a somewhat cup-shaped interior that opens in a first direction in which the material is to be dispensed from the dispensing device, the interior terminating at a discharge edge, and a skirt extending from the discharge edge in a second direction generally opposite the first direction, the skirt including a first side and a second side, and at least one passageway extending through the skirt from the first side to the second side.

2. The apparatus of claim 1 including multiple passageways.

3. The apparatus of claim 2 wherein the multiple passageways are substantially equally spaced around a perimeter of the skirt.

4. The apparatus of claim 3 further including means for mounting the dispensing device on a rotator for rotating the dispensing device to aid in dispensing the material.

5. The apparatus of claim 2 further including means for mounting the dispensing device on a rotator for rotating the dispensing device to aid in dispensing the material.

6. The apparatus of claim 1 further including means for mounting the dispensing device on a rotator for rotating the dispensing device to aid in dispensing the material.

7. A dispensing device for dispensing a material, the dispensing device having means for mounting the dispensing device on a rotator for rotating the dispensing device to aid in dispensing the material, said device defining a somewhat cup-shaped interiors that opens in a first direction in which the material is to be dispensed from the dispensing device, the interior terminating at a discharge edge, and a skirt extending from the discharge edge in a second direction generally opposite the first direction, and a housing, the housing including a feature cooperating with the skirt, the dispensing device being movable relative to the housing, the skirt and feature at least partly enclosing a region defined between the housing and the dispensing device.

8. The apparatus of claim 7 wherein the skirt includes a first side and a second side, and at least one passageway extending through the skirt from the first side to the second side, and further including a source of a compressed gas or mixture of gases coupled to the region, compressed gas from the source of a compressed gas or mixture of gases being exhausted from the region through the passageway.

9. The apparatus of claim 8 including multiple passageways substantially equally spaced around a perimeter of the skirt.

10. In combination, a dispensing device for dispensing a material, the dispensing device including means for mounting the dispensing device on a rotator for rotating the dispensing device to aid in dispensing the material, a housing surrounding the dispensing device, the housing and dispensing device including cooperating first and second features, the dispensing device being movable relative to the housing, the first and second features at least partly enclosing a region defined between the housing and the dispensing device, the cooperating first and second features include a skirt and a groove for receiving the skirt.

11. The combination of claim 10 wherein one of the first and second features includes at least one passageway, a first source of a compressed gas or mixture of gases coupled to the region, compressed gas from the first source being exhausted from the region through the passageway.

12. The combination of claim 11 wherein the skirt extends around a perimeter of the dispensing device and the groove extends along a surface of the housing.

13. The apparatus of claim 12 wherein there are a plurality of said passageways.

14. The apparatus of claim 13 wherein said passageways are substantially equally spaced around a perimeter of the skirt.

15. The combination of claim 14 further including a rotator, the dispensing device mounted on the rotator for rotation thereby.

16. The combination of claim 15 wherein the rotator is housed in the housing.

17. The combination of claim 13 further including a rotator, the dispensing device mounted on the rotator for rotation thereby.

18. The combination of claim 17 wherein the rotator is housed in the housing.

19. The combination of claim 11 further including a rotator, the dispensing device mounted on the rotator for rotation thereby.

20. The combination of claim 19 wherein the rotator is housed in the housing.

21. The combination of claim 11 further including a rotator, the dispensing device mounted on the rotator for rotation thereby.

22. The combination of claim 21 wherein the rotator is housed in the housing.

23. In combination, a first source of a compressed gas or mixture of gases, a second source of material to be dispensed, a rotator, a dispensing device mounted on the rotator for rotation thereby, the second source being coupled to the dispensing device, a housing surrounding the dispensing device, the housing and dispensing device including cooperating first and second features, the first and second features at least partly enclosing a region defined between the housing and the dispensing device, one of the first and second features including at least one passageway, the first source being coupled to the region, compressed gas from the first source being exhausted from the region through the passageway.

24. The apparatus of claim 23 wherein there are multiple passageways substantially equally spaced around a perimeter of the dispensing device.

25. The apparatus of claim 24 wherein the cooperating first and second features include a skirt and a groove for receiving the skirt.

26. The apparatus of claim 25 wherein the skirt extends around a perimeter of the dispensing device and the groove extends along a surface of the housing.

27. The apparatus of claim 26 wherein the at least one passageway is provided in the skirt.

28. The apparatus of claim 27 wherein the at least one passageway comprises multiple passageways.

29. The apparatus of claim 23 wherein the multiple passageways are substantially equally spaced around a perimeter of the skirt.

30. The apparatus of claim 23 wherein the material comprises pulverulent material entrained in a stream of a compressed gas or mixture of gases.

31. The apparatus of claim 30 wherein the second source includes a device for fluidizing pulverulent material.

32. The apparatus of claim 31 wherein the pulverulent material comprises a coating powder, and the device for fluidizing pulverulent material comprises a fluidized bed.

* * * * *